US008346151B2

(12) United States Patent
Akaike et al.

(10) Patent No.: US 8,346,151 B2
(45) Date of Patent: Jan. 1, 2013

(54) IMAGE FORMING APPARATUS INCLUDING A PLURALITY OF IMAGE FORMING SECTIONS AND A PLURALITY OF DISCHARGING PIPES

(75) Inventors: Takashi Akaike, Saitama (JP); Shigeki Nishimura, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 655 days.

(21) Appl. No.: 12/562,580

(22) Filed: Sep. 18, 2009

(65) Prior Publication Data

US 2010/0239340 A1 Sep. 23, 2010

(30) Foreign Application Priority Data

Mar. 19, 2009 (JP) ..... P2009-068297

(51) Int. Cl.
*G03G 21/10* (2006.01)

(52) U.S. Cl. ..... 399/358; 399/101

(58) Field of Classification Search ..... 399/358, 399/360, 101

See application file for complete search history.

(56) References Cited

U.S. PATENT DOCUMENTS

| | | | | |
|---|---|---|---|---|
| 2005/0058475 | A1* | 3/2005 | Tsurusaki | 399/358 |
| 2009/0074434 | A1* | 3/2009 | Ishii | 399/360 X |
| 2009/0080947 | A1* | 3/2009 | Suzuki et al. | 399/302 |
| 2009/0154972 | A1* | 6/2009 | Tanaka et al. | 399/358 |
| 2010/0172673 | A1 | 7/2010 | Akaike | 399/258 |

FOREIGN PATENT DOCUMENTS

| | | |
|---|---|---|
| JP | 05-045732 | 6/1993 |
| JP | 11-265121 | 9/1999 |
| JP | A-2004-198768 | 7/2004 |
| JP | 2005-084553 | 3/2005 |
| JP | 2006-171105 | 6/2006 |
| JP | 2006-235290 | 9/2006 |
| JP | 2008-052033 | 3/2008 |
| JP | 2009-020281 | 1/2009 |
| JP | 2010-160322 | 7/2010 |

* cited by examiner

*Primary Examiner* — Sophia S Chen
(74) *Attorney, Agent, or Firm* — Sughrue Mion, PLLC

(57) ABSTRACT

An image forming apparatus includes: a plurality of image forming sections respectively including developing portions and first removing portions as defined herein; a plurality discharging pipes as defined herein; and a delivery pipe as defined herein, the delivery pipe includes a changing portion in which a direction of delivering the coloring materials is changed to an upper side, and, among the discharging pipes, a discharging pipe that is downward extended from one of the first removing portions that is placed on a most downstream side in the oblique direction is disposed downstream from the changing portion of the delivery pipe in the delivering direction, and has a length shorter than lengths of the other discharging pipes.

7 Claims, 5 Drawing Sheets

IMAGE FORMING APPARATUS INCLUDING A PLURALITY OF IMAGE FORMING SECTIONS AND A PLURALITY OF DISCHARGING PIPES

CROSS-REFERENCE TO RELATED APPLICATIONS

This application is based on and claims priority under 35 USC 119 from Japanese Patent Application No. 2009-068297 filed on Mar. 19, 2009.

BACKGROUND

Technical Field

The present invention relates an image forming apparatus.

SUMMARY

According to an aspect of the invention, there is provided an image forming apparatus including: a plurality of image forming sections respectively having: developing portions which develop latent images formed on image carriers by using different coloring materials; and first removing portions which, after the images developed by the developing portions are transferred to transfer member, remove the coloring materials remaining on the image carriers, the image forming sections being arranged in a direction oblique to installation surface of a main unit of the apparatus; a plurality of discharging pipes which are placed below the plurality of image forming sections, which deliver the coloring materials removed by the first removing portions of the plurality of image forming sections, and which are downward extended from the first removing portions, respectively; and a delivery pipe which delivers the coloring materials introduced through the discharging pipes, to a recovery container, wherein the delivery pipe includes a changing portion in which a direction of delivering the coloring materials is changed to an upper side, and, among the discharging pipes, a discharging pipe which is downward extended from one of the first removing portions that is placed on a most downstream side in the oblique direction is disposed downstream from the changing portion of the delivery pipe in the delivering direction, and a length of the discharging pipe is shorter than lengths of the other discharging pipes.

BRIEF DESCRIPTION OF THE DRAWINGS

Exemplary embodiments of the present invention will be described in detail based on the following figures, wherein.

DESCRIPTION OF REFERENCE NUMERALS AND SIGNS

1 . . . image forming apparatus, 11 . . . case, 12 . . . sheet feeding device, 13 . . . sheet discharging portion, 14 . . . sheet conveying path, 14*a* . . . pickup roll, 14*b* . . . retard roll, 14*c* . . . correcting roll, 15 . . . fixing device, 20 . . . image formation processing section, 21Y, 21M, 21C, 21K . . . image forming unit, 22 . . . photosensitive member, 23 . . . charging device, 24 . . . developing device, 24*a* . . . housing, 24*b* . . . developing roll, 24*c* . . . supply auger, 24*d* . . . stir auger, 25 . . . photosensitive member cleaning portion, 25*a* . . . housing, 25*b* . . . blade, 25*c* . . . discharge auger, 25*d* . . . discharge port, 26Y, 26M, 26C, 26K . . . primary transfer roll, 27 . . . exposing device, 30 . . . driving roll, 31 . . . backup roll, 32 . . . driven roll, 33 . . . intermediate transfer belt, 34 . . . secondary transfer roll, 35Y, 35M, 35C, 35K . . . toner cartridge, 40 . . . belt cleaning portion, 40*a* . . . housing, 40*b* blade, . . . 40*c* . . . discharge auger, 40*d* . . . discharge port, 50 . . . toner recovering device, 51 . . . recovery container, 51*a* . . . introducing port, 51*b* . . . step portion, 51*c* . . . housing portion, 52 . . . conveying pipe, 53 . . . conveyor auger, 54 . . . motor, 520 . . . belt waste toner discharging pipe, 520*a* . . . receiving port, 520*b* . . . spring, 520*c* . . . movable member, 521Y, 521M, 521C, 521K . . . photosensitive member waste toner discharging pipe, 521*a* . . . receiving ports, 521*b* . . . shutter, 522 . . . delivery pipe, 522*a* . . . upstream portion, 522*b* . . . curved portion, 522*c* . . . downstream portion, 522*d* . . . delivery port, 530 . . . rotation shaft, 530*a* . . . standard diameter portion, 530*b* . . . small diameter portion, 530*c* . . . large diameter portion, 530*d* . . . very large diameter portion, 530*e* . . . taper portion, 531 . . . conveying vane, 532 . . . circulating vane

DETAILED DESCRIPTION

First Exemplary Embodiment

Figure 1:
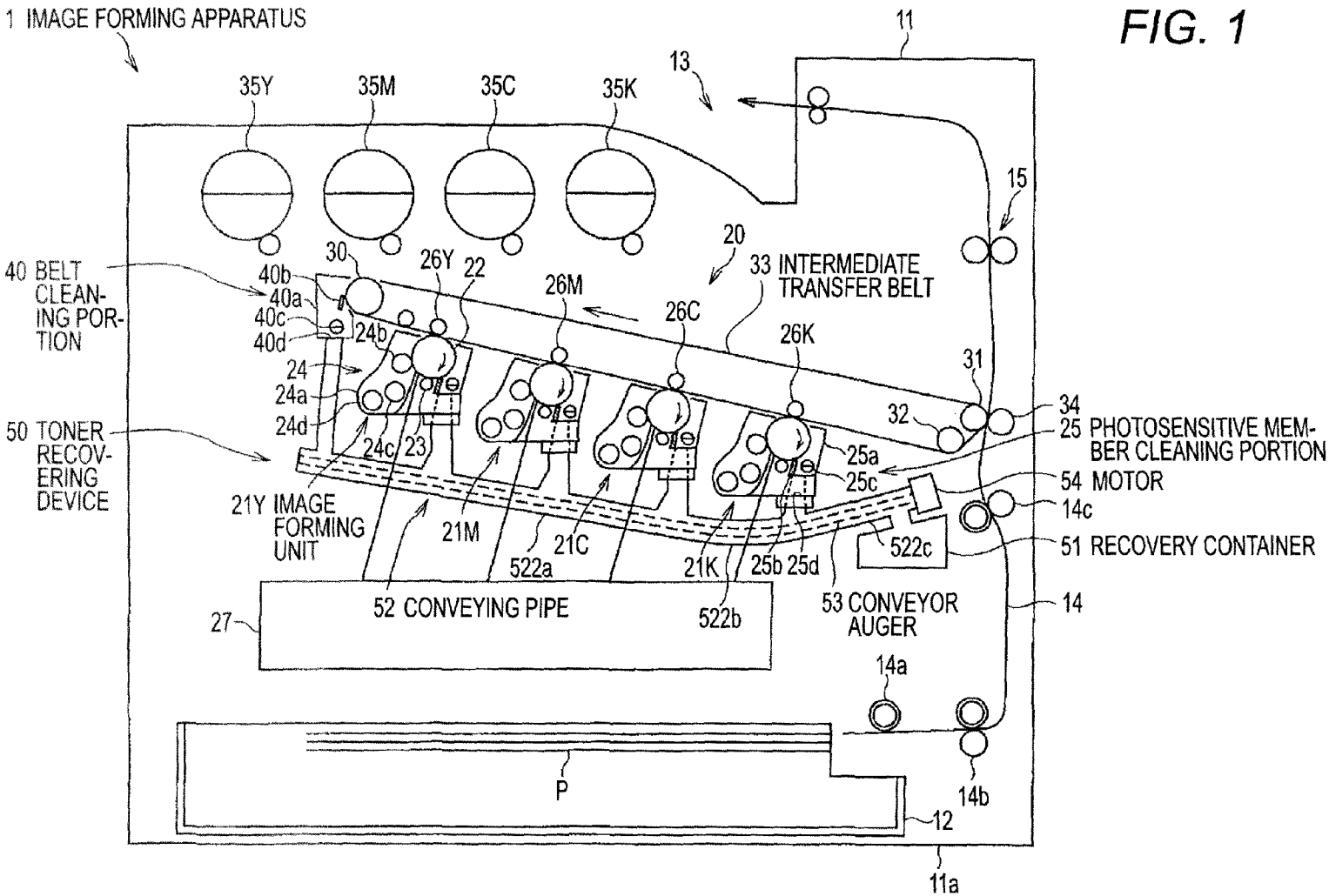
FIG. 1 is a diagram showing a configuration example of an image forming apparatus of a first exemplary embodiment of the invention.

FIG. 1 is a diagram showing a configuration example of an image forming apparatus of a first exemplary embodiment of the invention. For example, the image forming apparatus 1 is a digital color printer, and has a controlling section (not shown) which applies image processing to image data transmitted from a host apparatus such as a personal computer. The image forming apparatus 1 is configured so that the data are converted to color image data of yellow (Y), magenta (M), cyan (C), and black (K), and then a toner image based the color image data is formed on a sheet P.

The image forming apparatus 1 may be a copier, a facsimile apparatus, or a multi-function apparatus having a plurality of functions of a copier, a printer, a scanner, a facsimile apparatus, and the like. The image forming apparatus 1 may be connected to the host apparatus through a network such as a local area network (LAN), or in accordance with an interface standard such as USB or RS232C.

The image forming apparatus 1 has a case 11 as the apparatus main unit having a substantially box-like shape. A sheet feeding device 12 which houses sheets P is detachably disposed in a lower portion the case 11. In an upper portion of the case 11, a sheet discharging portion 13 onto which a recorded sheet P is to be discharged is disposed, and a sheet conveying path 14 as a recording member conveying path is formed so as to be extended from the sheet feeding device 12 to the sheet discharging portion 13. An installation surface 11*a* which is used in the case where the case 11 is installed on a floor or a table is disposed in the lower side of the case 11.

A pickup roll 14*a* which takes in the sheets P one by one from the sheet feeding device 12 to the sheet conveying path 14, a retard roll 14*b* which, in order to prevent the taken out sheet from double feeding, applies a force in a direction that is opposite to the conveying direction, on the rear face of the sheet, a correcting roll 14*c* which corrects the skew of the sheet P, and a fixing device 15 which fixes a toner image to the sheet P by means of heat and pressure are arranged on the sheet conveying path 14.

In the image forming apparatus 1, an image formation processing section 20 which forms toner images by using a plurality of color toners as different coloring materials is disposed in a middle portion case 11, and a toner recovering device 50 which recovers waste toner discharged from image formation processing section 20 is disposed below the image formation processing section 20. The waste toner which is to be recovered by the toner recovering device 50 may include magnetic carriers, paper dusts of the sheet P, powder dusts in the case 11, and the like, in addition to the toners.

(Image Formation Processing Section)

The image formation processing section 20 includes: an intermediate transfer belt 33 which can be circularly moved in the direction of the arrow in the figure, which functions as a transfer member; image forming units 21Y, 21M, 21C, 21K that are detachably arranged outside the intermediate transfer belt 33 while forming a constant gap and in direction oblique to the installation surface 11*a*, that respectively have photosensitive members 22 on which color toner images of YMCK are respectively formed while being rotated in the direction of the arrows in the figure, and which action as image carrier members, and that function as image forming sections; and primary transfer rolls 26Y, 26K, 26C, 26K which are placed inside the intermediate transfer 33, and which primary-transfer the toner images formed on the surfaces of the photosensitive members 22 to the intermediate transfer belt 33, respectively.

The intermediate transfer belt 33 is stretched by a plurality of rotary members. Specifically, the intermediate transfer belt 33 is stretched by: a driving roll 30 which drives the intermediate transfer belt 33 to be circularly moved, by a driving source (not shown) such as a motor; a backup roll 31 which is placed at a position where toner images are transferred to the sheet P, and which supports the intermediate transfer belt 33; and a driven roll 32 which is placed downstream from the image formation processing section 20 in the circularly moving direction of the intermediate transfer belt 33, and which is rotated in accordance with the circular movement of the intermediate transfer belt 33.

The image forming units 21Y, 21M, 21C, 21K are configured in the same manner. Each of the image forming units 21Y, 21M, 21C, 21K includes: the photosensitive member 22; a charging device 23 which uniformly charges the surface of the photosensitive member 22; a developing device 24 which develops an electrostatic latent image formed on the surface of the photosensitive member 22 by an exposing device 27, by a toner to form a toner image on the surface of the photosensitive member 22; and a photosensitive member cleaning portion 25 which recovers waste toner remaining on the surface of the photosensitive member 22, and which functions as a first removing portion.

The developing device 24 has a housing 24*a* which houses a toner. In the housing 24*a*, a developing roll 24*b* which supplies the toner to the photosensitive member 22 to develop an electrostatic latent image on the photosensitive member 22 with the toner; a supply auger 24*c* which supplies the toner to the developing roil 24*b*; and a stir auger 24*d* which stirs and supplies the toner to the supply auger 24*c* are disposed. The color toners are supplied from toner cartridges 35Y, 35M, 35C, 35K to the respective developing devices 24.

The photosensitive member cleaning portion 25 has a housing 25*a* which houses the waste toner recovered from the photosensitive member 22, and, in the housing 25*a*, includes: a blade 25*b* which is contacted with the surface of the photosensitive member 22 to scrape off waste toner; and a discharge auger 25*c* which is rotatably disposed in the housing 25*a*, and which is rotated to convey the waste toner that is scraped off by the blade 25*b* to be accumulated the housing 25*a*, toward the rear side of the image forming apparatus 1. A discharge port 25*d* through which the waste toner conveyed by the discharge auger 25*c* is discharged to the toner recovering device 50 is formed in a lower end portion of the rear side of the housing 25*a*.

The exposing device 27 includes components which are not shown, or four semiconductor laser devices which emit laser beams modulated with the color image data of YMCK, a polygon mirror which diverges the laser beams emitted from the semiconductor laser devices, and a plurality of mirrors which reflect the laser beams diverged by the polygon mirror, to irradiate the photosensitive members 22 with the laser beams, thereby forming electrostatic latent images on the surfaces of the photosensitive members 22. The exposing device 27 is hermetically closed by frames so as not to be contaminated with the toners and the like.

In the periphery of the intermediate transfer belt 33, a secondary transfer roil 34 which is placed on the side opposite to the backup roll 31 across the intermediate transfer belt 33, and which secondary transfers the toner images on the intermediate transfer belt 33 to the sheet P, and a belt cleaning portion 40 which is placed on the side opposite to the driving roll 30 across the intermediate transfer belt 33, which presses the intermediate transfer belt 33 toward the driving roll 30 to scrape off and recover waste toner remaining on the surface of the belt, and which functions as a second removing portion.

The belt cleaning portion 40 has a housing 40*a* which houses the waste toner recovered from the intermediate transfer belt 33, and, in the housing 40*a*, includes: a blade 40*b* which is contacted with the surface of the intermediate transfer belt 33 to scrape off waste toner; and a discharge auger 40*c* which is rotatably disposed in the housing 40*a*, and which is rotated to convey the waste toner that is scraped off by the blade 40*b* to be accumulated in the housing 25*a*, toward the rear side of the image forming apparatus 1. A discharge port 40*d* through which the waste toner conveyed by the discharge auger 40*c* is discharged to the toner recovering device 50 is formed in a lower end portion of the rear side of the housing 40*a*.

(Toner Recovering Device)

The toner recovering device 50 includes: a recovery container 51 which houses the waste toner; a conveying pipe 52 which conveys the waste toner removed by the photosensitive member cleaning portion 25 and the belt cleaning portion 40, to the recovery container 51; a conveyor auger 53 which is rotatably disposed in the conveying pipe 52, which is rotated to convey the waste toner to the recovery container 51, and which functions as a conveying member; and a motor 54 which rotates the conveyor auger 53, and which functions as a driving source.

The conveying pipe 52 is placed in the rear side of the image forming apparatus 1, so as not to interfere with the imago forming units 21Y, 21M, 21C, 21K, a driving source and gear train which are not shown, and which drive the photosensitive members 22 of the image forming units 21Y, 21M, 21C, 21K, and the like, and connected to the discharge ports 25*d* of the photosensitive member cleaning portions 25, and also to the discharge port 40*d* of the belt cleaning portion 40.

(Detailed Configuration of the Toner Recovering Device)

Figure 2:
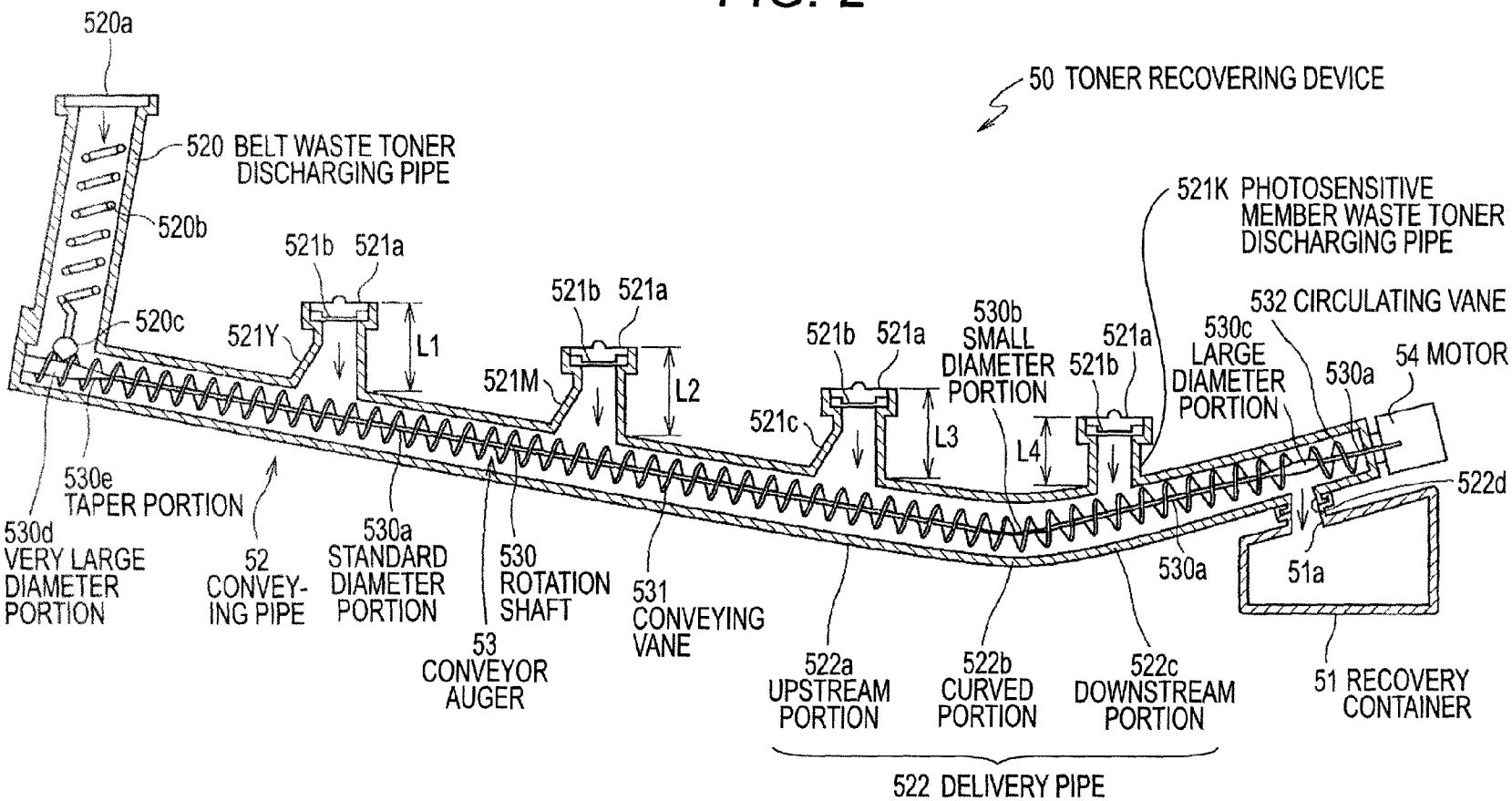
FIG. 2 is a sectional view showing a configuration example of a toner recovering device.
Figure 3:
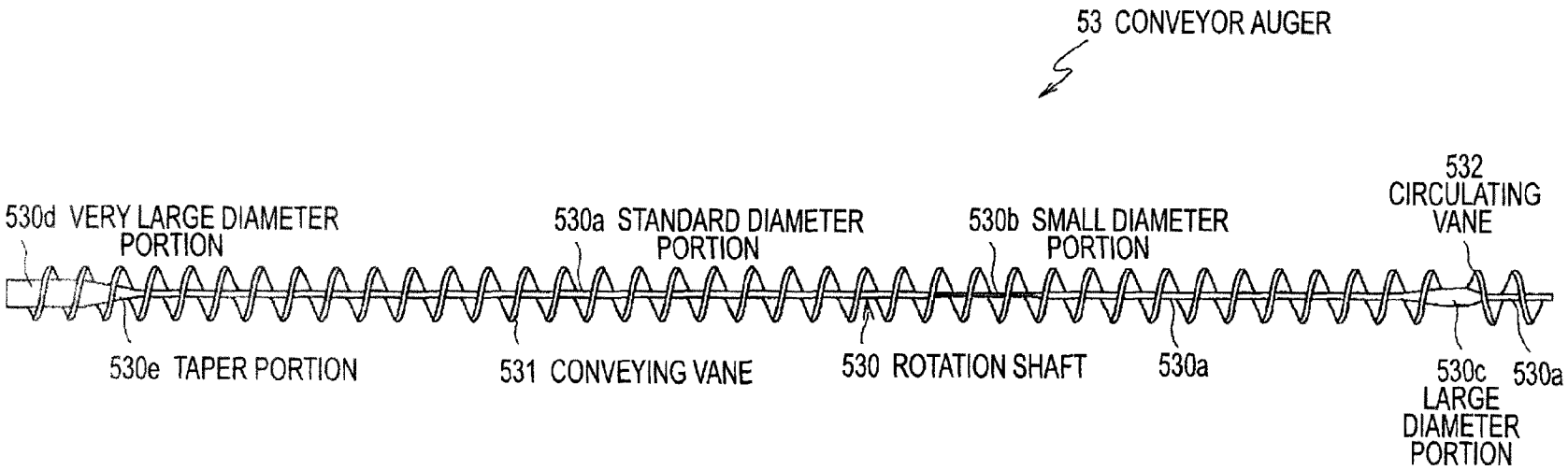
FIG. 3 is a plan view showing a configuration example of a conveyor auger.
Figure 4:
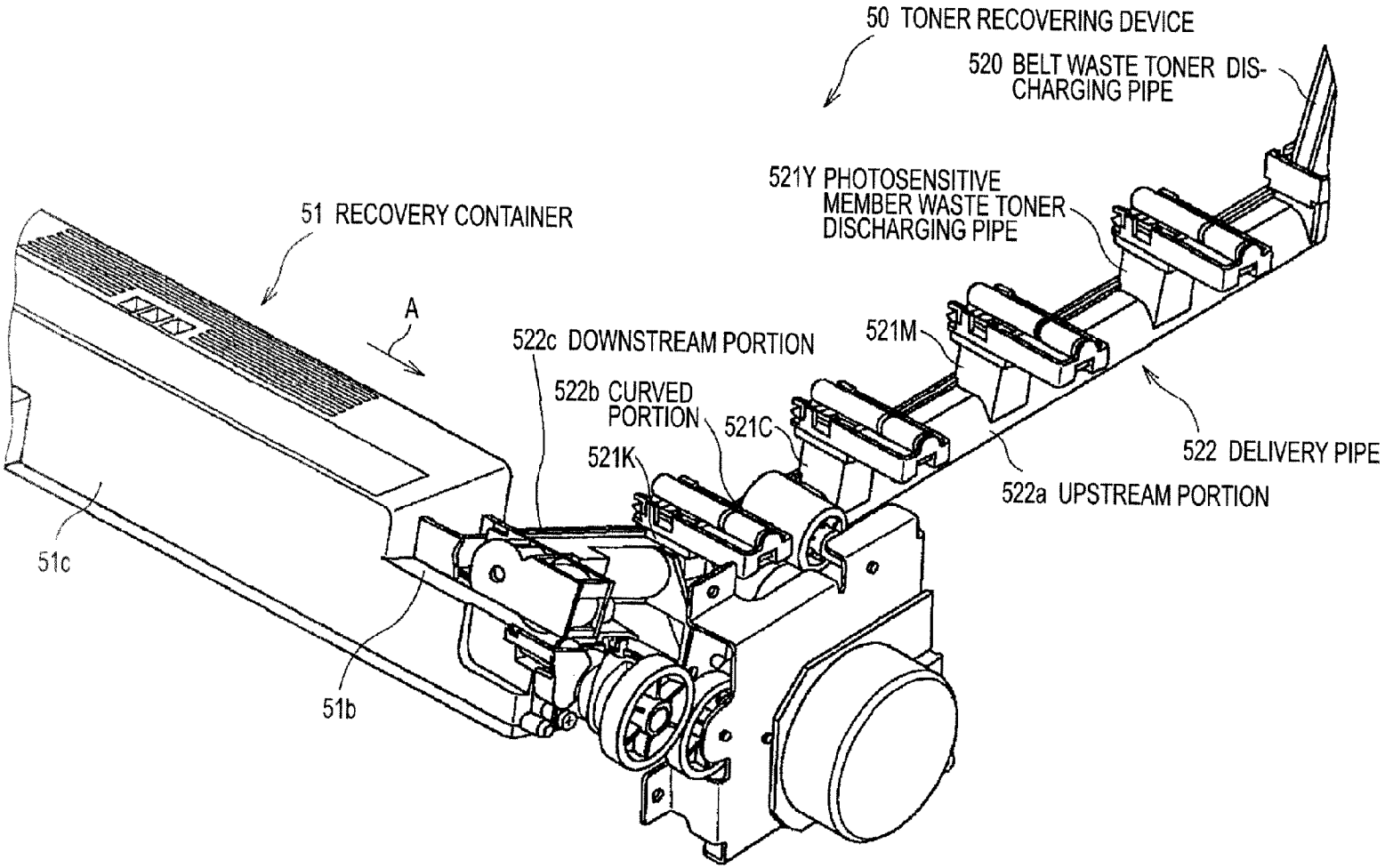
FIG. 4 is a perspective view showing configuration examples of a conveying pipe and a recovery container.

FIG. 2 is a sectional view showing a configuration example of the toner recovering device, FIG. 3 is a plan view showing a configuration example of the conveyor auger, and FIG. 4 is a perspective view showing configuration examples of the conveying pipe and the recovery container.

(Recovery Container)

The recovery container 51 is placed in a so-called dead space which is interposed among the sheet conveying path 14, the image forming unit 21K, and the exposing device 27, and inserted from the front side of the case 11 to the rear side, i.e., in the direction of arrow A shown in FIG. 4, whereby the recovery container is attached to the case 11. The very container 51 has: an introducing port 51*a* to which, when the container is attached to the case 11, the waster is introduced from the conveying pipe 52; a step portion 51*b* which is recessed so as not to interfere with the conveying pipe 52; and a housing portion 51*c* in which the level from the installation surface 11*a* partly overlaps with that of the conveying pipe 52. The step portion 51*b* and the housing portion 51*c* are hollows and communicate with each other, so that the waste toner introduced through the introducing port 51*a* is housed in the portions. A shutter which prevents the waste toner from leaking when the container is detached from the case 11 may be disposed in the introducing port 51*a*.

(Conveying Pipe)

As shown in FIG. 2, the conveying pipe 52 is configured by: a belt waste toner discharging pipe 520 which is downward extended from the belt cleaning portion 40; four photosensitive member waste toner discharging pipes 521Y, 521M, 521C, 521K which are downward extended from the photosensitive member cleaning portions 25 of the image forming units 21Y, 21M, 21C, 21K, respectively; and a delivery pipe 522 having a delivery port 522*d* through which the waste toner introduced through the belt waste toner discharging pipe 520 and the photosensitive member waste toner discharging pipes 521Y, 521M, 5210, 521K is delivered to the recovery container 51.

The conveying pipe 52 is formed by a resin such as an ABS resin, a polyacetal resin, or a polystyrene resin, or a metal such as aluminum. For example, the conveying pipe 52 is produced in the following manner. One set of members having a shape which is divided by the section shown in FIG. 2 is produced by a resin molding process, and the members are assembled while being opposed to each other. The radial sectional shape of the conveying pipe 52 may be circular or polygonal, but is not restricted thereto.

The belt waste toner discharging pipe 520 has in the upper part a receiving port 520*a* which is connected to the discharge port 40*d* of the belt cleaning portion 40. Inside the belt waste toner discharging pipe 520, a spring 520*b* which is placed below the belt cleaning portion 40, and a movable member 520*c* which is fixed to a lower portion of the spring 520*b*, and which is vertical movable in conjunction with the rotation of the conveyor auger 53 are disposed.

The photosensitive member waste toner discharging pipes 521Y, 5211, 5210, 521K have in an upper portion receiving ports 521*a* which are connected to the discharge ports 25*d* of the photosensitive member cleaning portions 25 of the image forming units 21Y, 21M, 21C, 21K, respectively. Shutters 521*b* which open and close the receiving ports 521*a* are disposed. Each of the shutters 521*b* is configured so that, when a corresponding one of the image forming units 21Y, 21M, 21C, 21K is attached, the shutter is opened.

The delivery pipe 522 is connected to the belt waste toner discharging pipe 520 and the photosensitive member waste toner discharging pipes 521Y, 521M, 521C, 521K, and also to the recovery container 51 through the delivery port 522*d*.

The delivery pipe 522 is placed while changing the direction of delivering the waste toner to the upper side so that, among the four connected photosensitive member waste toner discharging pipes 521Y, 521M, 521C, 521K, the length L4 of the photosensitive member waste toner discharging pipe 521K which is downward extended from the image forming unit 21K that is placed on the most downstream side in the oblique direction is shorter than the lengths L1 to L3 of the other the photosensitive member waste toner discharging pipes 521Y, 521M, 521C.

Along the direction from the upstream side in the delivering direction to the downstream side, the delivery pipe 522 has an upstream portion 522*a*, a curved portion 522*b* which functions as a changing portion, and a downstream portion 522*c*. In the upstream portion 522*a*, the belt waste toner discharging pipe 520 and the three photosensitive member waste toner discharging pipes 521Y, 521M, 521C which are on the upstream side are connected to the conveying pipe, and the direction of delivering the waste ton set to an oblique downward direction. The curved portion 522*b* is placed in a state where the portion is curved so that the delivering direction is changed from the oblique downward direction to the upper side, i.e., an oblique upward direction. In the downstream portion 522*c*, the photosensitive member waste toner discharging pipe 521K is connected to the conveying pipe, and the direction of delivering the waste is set to an oblique upward direction.

A configuration may be contemplated where the delivering direction of the upstream portion 522*a* of the conveying pipe is set to an oblique downward direction, the curved portion 522*b* is not disposed, and the downstream portion 522*c* is extended while maintaining the same inclination as the upstream portion 522*a*, and connected to the recovery container 51. In such a case, in order to ace the recovery container 51, however, the dimension of the apparatus main body in the height direction must be increased, and the size of the apparatus becomes large. According to the exemplary embodiment, by contrast, the direction delivering the waste is set to the oblique upward direction by the curved portion, whereby the size of the apparatus is reduced. Since the discharging pipe 521 which is connected to the downstream side from the curved portion 522*b* is shorter than the other discharging pipes, the recovery efficiency in the discharging pipe 521 is excellent.

In the market, the rate of the monochrome printing is higher than that of the full-color printing. In the image forming unit 21K which is connected to the downstream portion 522*c* through the photosensitive member waste toner discharging pipe 521K, and which uses the black toner, therefore, the amount of waste toner is larger as compared with the image forming units 21Y, 21M, 21C using the toners of the other colors. In the configuration where the direction of the delivery pipe 522 is changed to the oblique upward direction, consequently, the length L4 of the photosensitive member waste toner discharging pipe 521K is shortened, and the recovery efficiency of the waste toner is improved.

Although the exemplary embodiment is configured so that the angle by which the image forming unit 21K is obliquely placed substantially coincides with that of the delivering direction the delivery pipe 522, the angles may be different from each other. For example, the angle of the delivering direction of the delivery pipe 522 may approach one of the horizontal and vertical directions, or the angle of the placement of the image forming unit 21K may approach one of the horizontal and vertical directions.

(Conveyor Auger)

As shown in FIGS. 2 and 3, the conveyor auger 53 includes a rotation shaft 530 fixed to the motor 54, and a conveying vane 531 and circulating vane 532 which are spirally formed in the periphery of the rotation shaft 530.

The conveyor auger 53 is made of a bendable material, and integrally formed by a molding process using a resin such as an ABS resin, a polycarbonate resin, a polyacetal resin, or a polystyrene resin, or a metal such as aluminum. The conveying vane 531 and the circulating vane 532 may not be spirally formed on the rotation shaft 530. Alternatively, a plurality of feeding plates may be inclinedly disposed on the rotation shaft 530. In the exemplary embodiment, as shown in FIG. 3, the conveyor auger 53 is linearly formed, then curved so as to coincide with the shape of the delivery pipe 522, and thereafter placed in the delivery pipe 522. Alternatively, the conveyor auger may be previously curved so as to coincide with the shape of the delivery pipe 522.

The rotation shaft 530 is configured so that the diameter of a shaft portion is changed depending on the zone of the delivery pipe 522 where the shaft portion is placed, and has: a standard diameter portion 530*a* having a standard diameter of the rotation shaft 530; a small diameter portion 530*b* which is smaller in diameter than the standard diameter portion 530*a*; a large diameter portion 530*c* which is larger in diameter than the standard diameter portion 530*a*; a very large diameter portion 530*d* which is larger in diameter than the large diameter portion 530*c*; and a taper portion 530*e* in which the diameter is gradually reduced.

The small diameter portion 530*b* is disposed in the curved portion 522*b* so that the rotation shaft easily follows the shape of the curved portion 522*b*.

The large diameter portion 530*c* is disposed at a position where the recovery container 51 is connected to the delivery pipe, or a position where the conveying vane 531 and the circulating vane 532 are omitted, so that strength of the rotation shaft 530 is enhanced.

The very large diameter portion 530*d* is disposed at a position where the movable member 520*c* of the belt waste toner discharging pipe 520 is placed, so that the height of the conveying vane 531 is reduced in order to cause the movable member 520*c* to easily override the conveying vane 531.

The taper portion 530*e* is disposed downstream from the very large diameter portion 530*d*. The diameter of the taper portion is gradually reduced, and finally coincides with that of the standard diameter portion 530*a*. The taper portion 530*e* has a function of gradually increasing the conveying speed of the waste tone, and adjusting the conveying amount of the waste toner per unit time.

The conveying vane 531 is formed in the periphery of the rotation shaft 530 on the upstream side from the large diameter portion 530*c*. When the rotation shaft 530 is rotated by the rotation or the motor 54, the conveying vane 531 conveys the waste toner discharged from the belt waste toner discharging pipe 520 and the photosensitive member waste toner discharging pipes 521Y, 521M, 521C, 521K, along the rotation shaft 530 to the delivery port 522*d*, and delivers the waste toner the recovery container 51 through the delivery port 522*d*.

The circulating vane 532 is formed in the periphery of the rotation shaft 530 on the downstream side from the large diameter portion 530*c*, in a direction opposite to the conveying vane 531. The circulating vane 532 conveys the waste toner conveyed by the conveying vane 531, so as to push back the waste toner in a direction opposite to the delivering direction.

(Operation of Image Forming Apparatus)

Next, an example of the operation of the image forming apparatus will be described. Hereinafter, the case where the user operates the host apparatus to transmit to-be-processed image data to the image forming apparatus 1 will be described.

When the image forming apparatus 1 receives the image data from the host apparatus, the apparatus controls the image formation processing section 20 and the like to form images based on the image data.

The image formation processing section 20 causes the photosensitive members 22 of the image forming units 21Y, 21M, 21C, 21K to be rotated, charges the photosensitive members 22 by the charging devices 23, and then irradiates the photosensitive members 22 with the laser beams for the respective colors which are based on the image data and emitted from the exposing device 27, thereby forming electrostatic latent images on the surfaces of the photosensitive members 22. Next, the electrostatic latent images on the photosensitive members 22 are developed by the developing devices 24 for the corresponding colors to charged toner images, and then gradually primary transferred onto the intermediate transfer belt 33 driven by the driving roll 30, by the primary transfer rolls 26Y, 26M, 26C, 26K.

After the toner images are primary transferred, toners remaining on the surfaces of the photosensitive members 22 are scraped off by the blades 25*b* of the photosensitive member cleaning portion 25, and then housed in the housings 25*a*. The waste toners housed in the housings 25*a* are conveyed towards the rear side by the rotations of the discharge augers 25*c*, to be discharged into the photosensitive member waste toner discharging pipes 521Y, 521M, 521C, 521K through the discharge ports 25*d*.

On the other hand, in parallel with the operation of the image formation processing section 20, the sheet P is conveyed one by one from the sheet feeding device 12 by the pickup roll 14*a* and the retard 14*b*, and the skew is corrected by the correcting roll 14*c*. When the sheet P is conveyed to the position where the secondary transfer roll 34 is placed, in synchronization with the circular movement of the intermediate transfer belt 33, the toner images on the intermediate transfer belt 33 are secondary transferred to the sheet P by the secondary transfer roll 34. The sheet P onto which the toner images are secondary transferred is heated and pressurized by the fixing device 15, thereby fixing the toner images, and then discharged to the sheet discharging portion 13.

After the toner images are secondary transferred from the intermediate transfer belt 33 to the sheet P, a toner remaining on the surface of the intermediate transfer belt 33 is scraped off by the blade 40*b* of the belt cleaning portion 40, and then housed into the housing 40*a*. The waste toner housed in the hour housing 40*a* is conveyed toward the rear side by the rotation of the discharge auger 40*c*, and discharged to the belt waste toner discharging pipe 520 through the discharge port 40*d*.

In the image formation, the waste toner removed by the belt cleaning portion 40 is conveyed to the belt waste toner discharging pipe 520 through the receiving port 520*a*. When the conveyor auger 53 is rotated by the motor 54, the movable member 520*c* in the conveying pipe 52 is vertically moved by successive overriding of the member over the conveying vane 531 of the conveyor auger 53. As a result, also the spring 520*b* fixed to the movable member 520*c* is vertically moved. While preventing the toner from adhering to the inner wall face of the belt waste toner discharging pipe 520, therefore, the waste toner removed by the belt cleaning portion 40 drops from the belt waste toner discharging pipe 520 into the upstream portion 522*a*.

The waste toner which drops into the upstream portion 522*a* is conveyed in the oblique downward direction along the rotation shaft 530 by the conveying vane 531.

In the upstream portion 522*a*, the waste toners removed, by the photosensitive member cleaning portions 25 of the image forming units 21Y, 21M, 21C are introduced through the connected photosensitive member waste toner discharging pipes 521Y, 521M, 521C, and then conveyed in the oblique direction by the conveying vane 531.

When the waste toner which is conveyed in the oblique direction reaches the curved portion 522*b*, the waste toner arcuately advances along the curved rotation shaft 530 through the curved portion 522*b*, so that the conveying direction of the waste toner is changed to the upper side, and then the waste toner reaches the downstream portion 522*c*.

In the downstream portion 522*c*, then, the waste toner removed by the photosensitive member cleaning portion 25 of the image forming unit 21K is introduced through the photosensitive member waste toner discharging pipe 521K, and conveyed in the oblique upward direction by the conveying vane 531.

When the waste toner which is conveyed in the oblique upward direction reaches the delivery port 522*d* in the downstream portion 522*c*, the waste toner is recovered into the recovery container 51 through the delivery port 522*d*. At this time, the waste toner which has passed over the delivery port 522*d* is pushed back in the opposite direction by the circulating vane 532, whereby the waste toner is recovered into the recovery container 51 through the delivery port 522*d*.

Second Exemplary Embodiment

Figure 5:
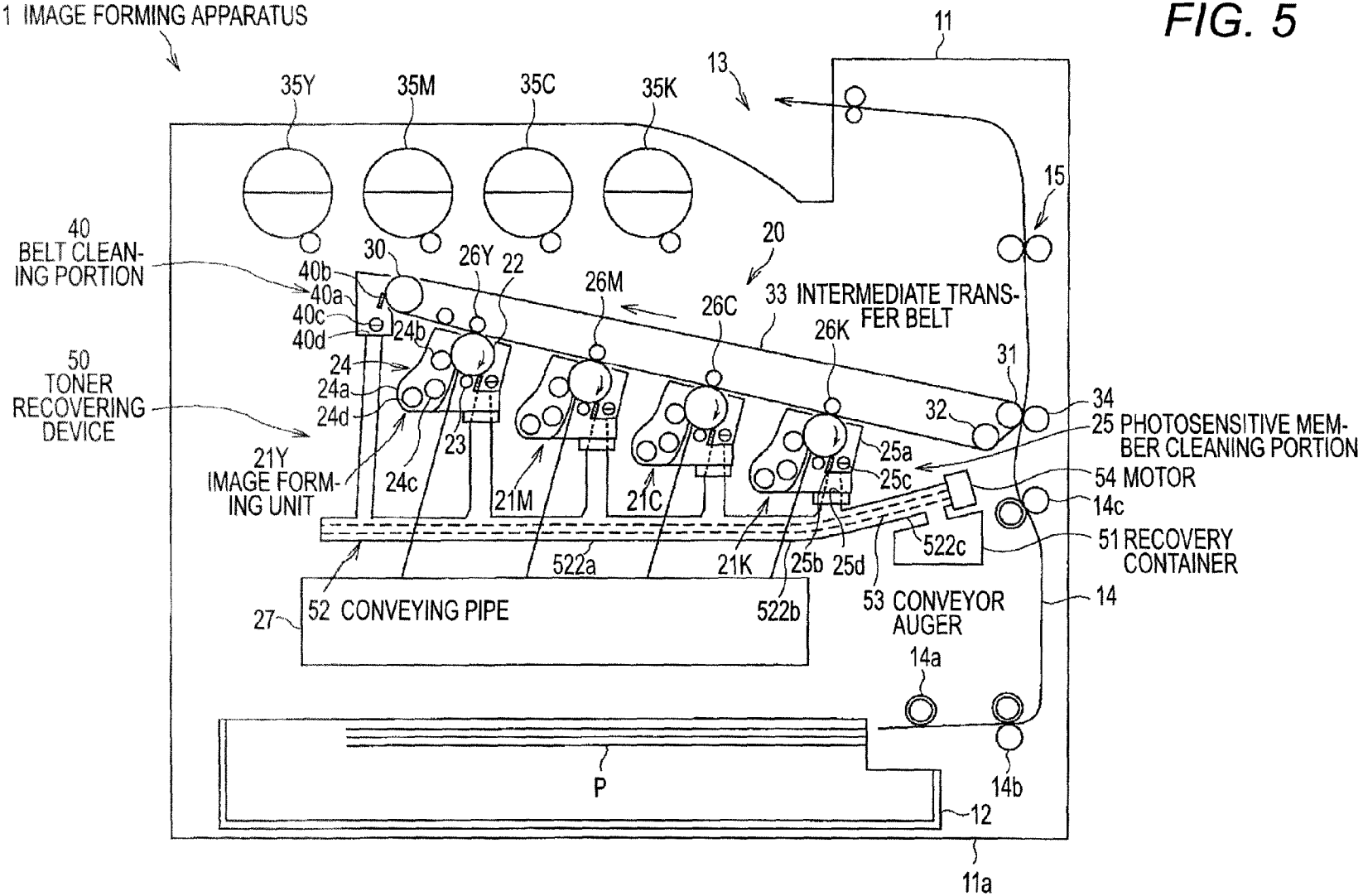
FIG. 5 is a diagram showing a configuration example of an image forming apparatus of a second exemplary embodiment of the invention.

FIG. 5 is a diagram showing a configuration example of an image forming apparatus of a second exemplary embodiment of the invention. In the image forming apparatus 1 of the first exemplary embodiment, the upstream portion 522*a* of the delivery pipe 522 is placed so as to convey the waste toner in the oblique downward direction. In the image forming apparatus 1 of the present exemplary embodiment, by contrast, the upstream portion 522*a* of the delivery pipe 522 is placed so as to horizontally deliver the waste toner.

In the upstream portion 522*a*, the direction of delivering the waste toner is set to the horizontal direction, and, in the downstream portion 522*c*, the direction is set to an obliquely upward direction. The curved portion 522*b* between the upstream portion 522*a* and the downstream portion 522*c* is curvedly placed so that the delivering direction is changed from the horizontal direction to the obliquely upward direction. The other basic configuration and operation of the image forming apparatus 1 are identical with those of the first exemplary embodiment, and hence their detailed description is omitted.

Other Exemplary Embodiments

The invention is not restricted to the exemplary embodiments, and may be variously implemented without departing from the spirit of the invention. In the image forming apparatuses 1 of the exemplary embodiments, for example, toner images on the photosensitive members 22 are transferred, through the intermediate transfer belt 33 which functions as a transfer member, to the sheet P which functions as another transfer member. Alternatively, the intermediate transfer belt 33 may be omitted, and toner images on the photosensitive members 22 may be directly transferred to the sheet P.

In the exemplary embodiments, the curved portion 522*b* of the delivery pipe 522 is placed so as to be bent at a predetermined radius of curvature. Alternatively, the curved portion may be placed while being bent so that the upstream portion 522*a* and the downstream portion 522*c* intersect with each other at a predetermined angle.

In the exemplary embodiments, the curved portion 522*b* of the delivery pipe 522 is disposed in one place. Alternatively, the curved portion may be placed at plural places.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

a plurality of image forming sections respectively comprising: developing portions that develop latent images formed on image carriers with different coloring materials; and first removing portions that, after the images developed by the developing portions are transferred to a transfer member, remove the coloring materials remaining on the image carriers, the image forming sections being provided in a direction oblique to an installation surface of a main unit of the apparatus;

a plurality of discharging pipes that are provided below the plurality of image forming sections, that deliver the coloring materials removed by the first removing portions of the plurality of image forming sections, and that are downward extended from the first removing portions, respectively; and a delivery pipe that delivers the coloring materials introduced through the discharging pipes, to a recovery container, wherein the delivery pipe comprises a changing portion in which a direction of delivering the coloring materials is changed to an upper side, and, among the discharging pipes, a discharging pipe that is downward extended from one of the first removing portions that is placed on a most downstream side in the oblique direction is disposed downstream from the changing portion of the delivery pipe in the delivering direction, and has a length shorter than lengths of the other discharging pipes.

2. The image forming apparatus according to claim 1, wherein, in one of the plurality of image forming sections that is placed on a most downstream side in the delivering direction, the developing portion uses a black coloring material.

3. The image forming apparatus according to claim 2, wherein the apparatus further comprises a conveying member which is in the delivery pipe, which has a rotation shaft that is disposed along the delivering direction, and a vane that is formed in a periphery of the rotation shaft, and in which the rotation shaft is rotated by a driving source, so as to convey the coloring materials in the delivering direction.

4. The image forming apparatus according to claim 3, wherein the apparatus further comprises a second removing portion that, after the images transferred to the transfer member is transferred to another transfer member, removes the coloring materials remaining on the transfer member, and the delivery pipe introduces the coloring materials removed by the second removing portion, into the recovery container through a discharging pipe that is downward extended from the second removing portion.

5. The image forming apparatus according to claim 3, wherein, in the rotation shaft of the conveying member, a diameter of a portion that is disposed in the changing portion is smaller than a diameter of another portion.

6. The image forming apparatus according to claim 3, wherein the vane of the con member in an upstream side of a position where the recovery container is placed is formed in a direction opposite to a direction of the vane of the conveying member in a downstream side.

7. The image forming apparatus according to claim 1, wherein the recovery container is provided in a space surrounded by the delivery pipe that is disposed downstream from the changing portion in the delivering direction, a recording member conveying path through which a recording member is conveyed, and an exposing device that exposes a photosensitive member.

* * * * *